US006595563B2

(12) United States Patent
Kiernan

(10) Patent No.: US 6,595,563 B2
(45) Date of Patent: Jul. 22, 2003

(54) ELECTRIC STRIKE FIELD-SELECTABLE FAIL-SAFE/FAIL-SECURE MECHANISM

(75) Inventor: Brent Kiernan, Fishers, IN (US)

(73) Assignee: Von Duprin, Inc., Indianapolis, IN (US)

( * ) Notice: Subject to any disclaimer, the term of this patent is extended or adjusted under 35 U.S.C. 154(b) by 0 days.

(21) Appl. No.: 09/951,795

(22) Filed: Sep. 13, 2001

(65) Prior Publication Data

US 2002/0029526 A1 Mar. 14, 2002

Related U.S. Application Data

(60) Provisional application No. 60/232,223, filed on Sep. 13, 2000.

(51) Int. Cl.[7] ..... E05B 15/02

(52) U.S. Cl. ..... 292/341.16; 292/341.15; 292/341.17; 292/201

(58) Field of Search ..... 292/341.16, 341.15, 292/341.17, 201

(56) References Cited

U.S. PATENT DOCUMENTS

| | | | | | |
|---|---|---|---|---|---|
| 358,975 | A | * | 3/1887 | Henzel | 292/341.6 |
| 1,121,090 | A | * | 12/1914 | Guett | 292/341.16 |
| 3,211,850 | A | * | 10/1965 | Toepfer | 200/61.64 |
| 3,819,215 | A | * | 6/1974 | Fuss | 292/201 |
| 3,910,617 | A | * | 10/1975 | Scalza et al. | 292/341.16 |
| RE30,263 | E | * | 4/1980 | Horvath | 292/341.16 |
| 4,211,443 | A | | 7/1980 | Butts et al. | |
| 4,471,983 | A | * | 9/1984 | Bischoff et al. | 292/341.16 |
| 4,595,220 | A | * | 6/1986 | Hanchett, Jr. et al. | 292/341.17 |
| 4,626,010 | A | | 12/1986 | Hanchett, Jr. et al. | |
| 4,756,566 | A | | 7/1988 | Logas | |
| 4,815,776 | A | | 3/1989 | Fuss | |
| 4,838,591 | A | | 6/1989 | Fuss | |
| 4,867,496 | A | * | 9/1989 | Thomas | 292/341.16 |
| 4,917,425 | A | | 4/1990 | Logas | |
| 4,984,835 | A | * | 1/1991 | Vadacchino et al. | 292/341.16 |
| 4,986,584 | A | | 1/1991 | Logas | |
| 5,076,625 | A | * | 12/1991 | Oxley | 292/341.16 |
| 5,100,186 | A | | 3/1992 | Nordvall | |
| 5,118,150 | A | | 6/1992 | Jarrett | |
| 5,127,691 | A | * | 7/1992 | Herron et al. | 292/341.16 |
| 5,219,196 | A | * | 6/1993 | Luker | 292/341.16 |
| 5,439,262 | A | | 8/1995 | Fuss et al. | |
| 5,484,180 | A | | 1/1996 | Helmar | |
| 5,490,699 | A | | 2/1996 | Uyeda | |
| 5,511,839 | A | | 4/1996 | Fuss et al. | |

(List continued on next page.)

FOREIGN PATENT DOCUMENTS

| | | |
|---|---|---|
| GB | 1326545 | 8/1973 |

OTHER PUBLICATIONS

Portions of "ROFU International Corporation", dated Apr. 1996.
"Securitron: Securitron Model UNL–12 Unlatch Installation and Operation Instructions", dated Jun. 1998.
"Yortec Products—Electric Strike", dated Jul. 30, 1999.

(List continued on next page.)

*Primary Examiner*—Robert J. Sandy
*Assistant Examiner*—Carlos Lugo
(74) *Attorney, Agent, or Firm*—Michael Best & Friedrich LLP

(57) ABSTRACT

An electrically controlled strike including a strike frame; a keeper carried by the strike frame for movement when released allowing door opening and adapted to receive and resist door opening prior to keeper movement, an electrically powered solenoid carried by the frame, and a lock arm assembly operatively connected between the solenoid and the keeper for causing the keeper to assume a fail-safe condition allowing keeper movement when the solenoid is unpowered or alternatively a fail-secure condition preventing keeper movement when the solenoid is unpowered, the two conditions being selected by re-positioning an actuator.

22 Claims, 4 Drawing Sheets

U.S. PATENT DOCUMENTS

| | | | | | |
|---|---|---|---|---|---|
| 5,654,865 | A | | 8/1997 | Ryan | |
| 5,681,070 | A | * | 10/1997 | Williams et al. | 292/341.16 |
| 5,690,373 | A | | 11/1997 | Luker | |
| 5,735,559 | A | | 4/1998 | Frolov | |
| 5,788,295 | A | | 8/1998 | Fuss et al. | |
| 5,850,753 | A | * | 12/1998 | Varma | 70/278 |
| 5,924,750 | A | | 7/1999 | Fuss et al. | |
| 5,934,720 | A | | 8/1999 | Karalius | |
| 5,988,711 | A | | 11/1999 | Toma | |
| 6,021,038 | A | | 2/2000 | Hanchett, Jr. | |
| 6,076,870 | A | | 6/2000 | Frolov | |
| 6,082,791 | A | * | 7/2000 | Frolov et al. | 292/341.16 |
| 6,299,225 | B1 | * | 10/2001 | Chang | 292/341.16 |

OTHER PUBLICATIONS

"Yortec Products—Electric Strike", dated Jul. 30, 1999.
Trimec Advertisements, dated Jun. 1998 and Jul. 1998.
"JLM Wholesale Complete Door Hardware Solutions", dated summer 1998.
Advertisement entitled "Gianni Industries Inc.", published Mar. 25, 2000.
"Adams Rite 7300 Electric Strike", shown in the Aug. 1999 issue of the *The National Locksmith*.
A number of electric strikes, shown in the Aug. 1999 issue of *The National Locksmith*.
"Low Profile Strike", shown in the Nov. 1999 issue of *Security Distributing & Marketing*.
"ROFU Model 2400 Electric Strike", shown in *The National Locksmith*.
An advertisement for "Electric Strike", available prior to Mar. 3, 1999.
Advertisement entitled "Trine Cuts Out Your Small Space Problems With Micro–Technology", dated Sep. 11, 2000.

* cited by examiner

ELECTRIC STRIKE FIELD-SELECTABLE FAIL-SAFE/FAIL-SECURE MECHANISM

This patent application claims the benefit of Provisional Patent Application No. 60/232,223, filed Sep. 13, 2000.

FIELD OF THE INVENTION

This invention relates generally to the field of door security systems. More specifically, this invention relates to an improved electrically energizable, solenoid operated, door-strike mechanism that is easily switchable, to either of two different selected modes of operation. In one mode of operation the mechanism is in a fail-safe mode, wherein, if power to the solenoid fails, a keeper moves to allow a door to be safely opened. The other mode is called fail-secure, wherein, if power to the solenoid fails, the keeper secures the door against opening.

BACKGROUND OF THE INVENTION

Electric strikes for securing hinged or swinging doors are well-known in the field of door security systems. The electric strikes are employed with doors having projectable deadbolts or latch bolts that engage the electric strike. The electric strike can be configured to secure the door alone, or in combination with other conventional security systems. The electric strike typically is mounted to the door frame and defines an opening in the jam face of the door frame for receiving the latch bolt and/or deadbolt from the lockset mounted to the door. The electric strike further defines an opening in the frame face contiguous with the opening in the jam face of the door frame. A pivotal keeper on the electric strike selectively closes the opening in the frame face. A bolt, projecting from the edge of the door, engages the electric strike through the opening in the jam face. Actuation of the electric strike locks or unlocks the keeper. The keeper is pivotable to uncover or open the frame face opening to allow the bolt to swing there through, and thereby allow opening of the door. The keeper is pivoted by the door being pushed, whereby the bolt engages the keeper of the strike.

The lock assembly of a conventional electric strike is commonly operated by a solenoid. The solenoid is typically configured to be spring-biased so that energization of the solenoid overcomes the biasing force of the spring to either lock or unlock the electric strike. In a first configuration the power must be continuously supplied to the solenoid in order to maintain the electric strike in a locked condition. This configuration requires a relatively high and continuous input of energy and therefore, typically requires electrical wiring to the doorway from an electric line source.

Similarly, electric strikes that are configured to unlock upon energization can also require a continuous supply of energy in order to maintain the lock in unlocked condition.

There is a need for electrically-controlled strike mechanisms of simple, compact, construction for securing doors against opening (fail-secure mode), and also for allowing door opening (fail-safe mode), in the case of power failure. Most mechanisms permitting these two functions require two different strike devices, each device permitting only one of these functions. Current mechanisms which embody the two functions in a single mechanism require complicated disassembly and reassembly in order to accommodate both modes of operation. This invention permits alternating between fail-safe and fail-secure operation by simply turning a single part, an actuator, 180°.

SUMMARY OF THE INVENTION

Briefly stated, the electric strike in the preferred form employs a solenoid to transform the electric strike between the locked and unlocked states. The solenoid allows for the use of an on-board power source, such as batteries, or an exterior power source to energize the electric strike. In the event that the power source is terminated, for example, because of power failure, it may be desired that the electric strike automatically engages in a fail-safe or alternatively a fail-secure mode. The electric strike includes a means operatively connected between the solenoid and the keeper for causing the keeper to assume a fail-safe condition allowing the keeper to pivot when the solenoid is in either position, or alternatively a fail-secure condition preventing the keeper from pivoting when the solenoid is in either position. In the present invention, the means connecting the solenoid to the keeper can be configured in either mode by simply opening the strike, removing a solenoid assembly and actuators, turning the actuator over and reinserting the removed parts. This permits easy selection of either mode by an unskilled human operator, in the field, in a short period of time, without complicated disassembly and reassembly of the strike mechanism.

The actuator is a simple, unique, mechanical connection between a solenoid assembly and a lock link that permits or prevents the keeper from unlocking. The actuator is designed to operate in either of two positions. With one side up, the actuator is spring-biased to push the lock link into a fail-safe mode if the solenoid is unpowered. The actuator can be removed and reinserted with the other side or opposite side up. In this second position, the actuator is spring-biased to push the lock link into a fail-secure mode if the solenoid is unpowered.

It is an object of the invention to provide an improved and relatively compact electric door strike for controlling access through a doorway with a mechanism that permits alternatively selecting a fail-safe condition or alternatively fail-secure condition with a simple easy mechanical reconfiguration that can be accomplished quickly in the field.

It is another object of the invention to provide an electric strike mechanism that can be selectively configured in a fail-safe or fail-secure mode without a special operator, special tools or the addition of external devices.

These and other objects of the invention will become apparent from a review of the specification and the drawings.

DESCRIPTION OF THE PREFERRED EMBODIMENT

Figure 1:
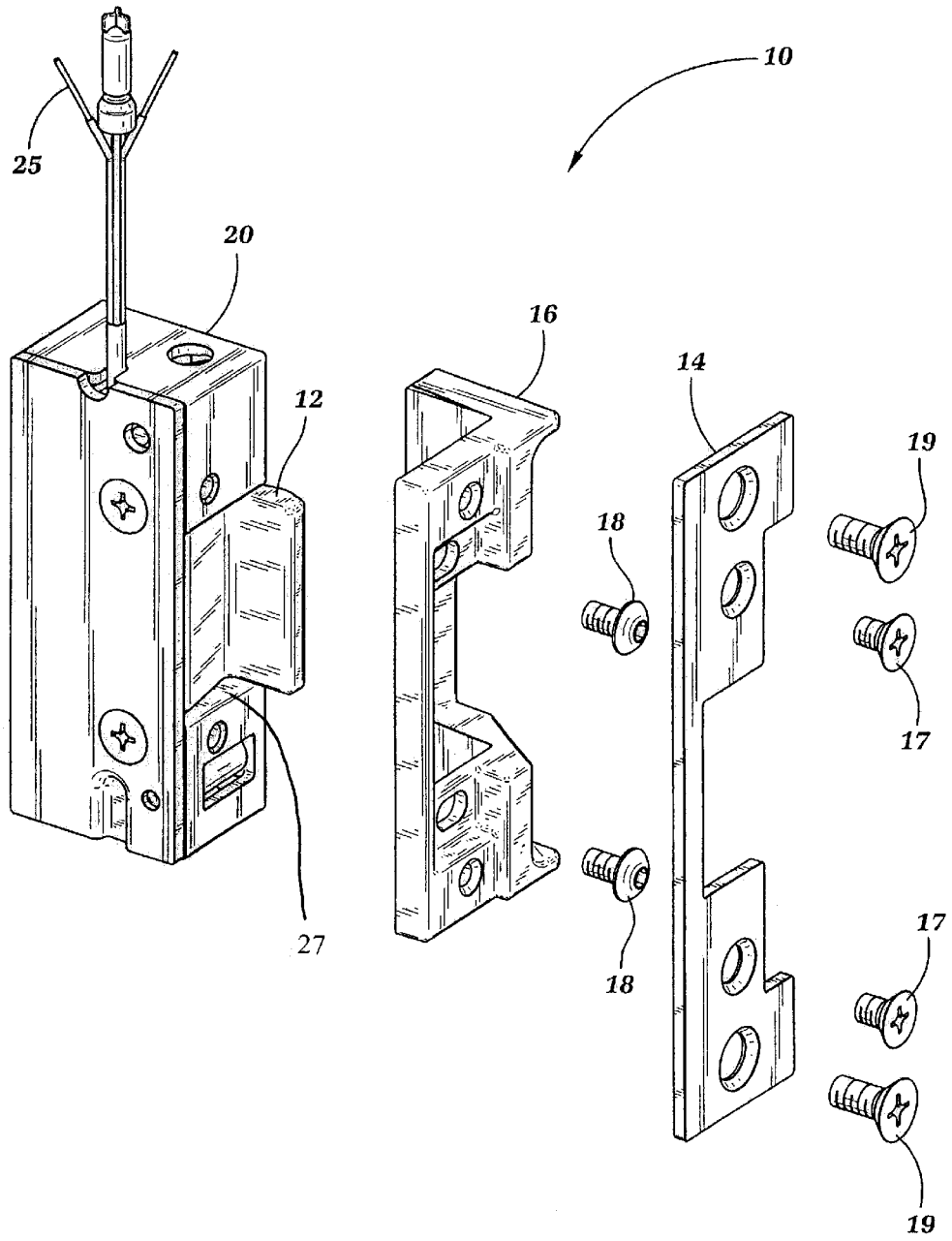
FIG. 1 is a partially exploded perspective view, of an electric strike in accordance with the invention.

With reference to the drawings wherein like numerals represent like parts, an electric strike is generally designated by numeral 10. The electric strike 10 comprises one main assembly and two mounting parts. Referring to FIG. 1, the main assembly is called a backbox assembly 20. The mounted parts comprise a face plate 14 and a lip attachment 16. The face plate 14 is attached by flat-head screws 17 to the lip attachment 16. The backbox assembly 20 is attached to the lip attachment 16 by button-head screws 18, and the face plate is attached to a door frame (not shown) by additional flat-head screws 19.

The backbox assembly 20 includes a keeper 12 and wires 25 for connection to a power source to power the electric strike 10.

The electric strike 10 is mounted to a vertical edge of a door frame (not shown). The electric strike 10 can preferably, without modification, be readily mounted to a door frame with either left or right opening doors. The door (not shown) will have conventional lock hardware including a latch set with a latch bolt or deadbolt that extends from the door edge for engagement with the electric strike 10. The electric strike 10 is positioned in a cut out through a door frame face and jam face of the doorframe.

Figures 2, 8:
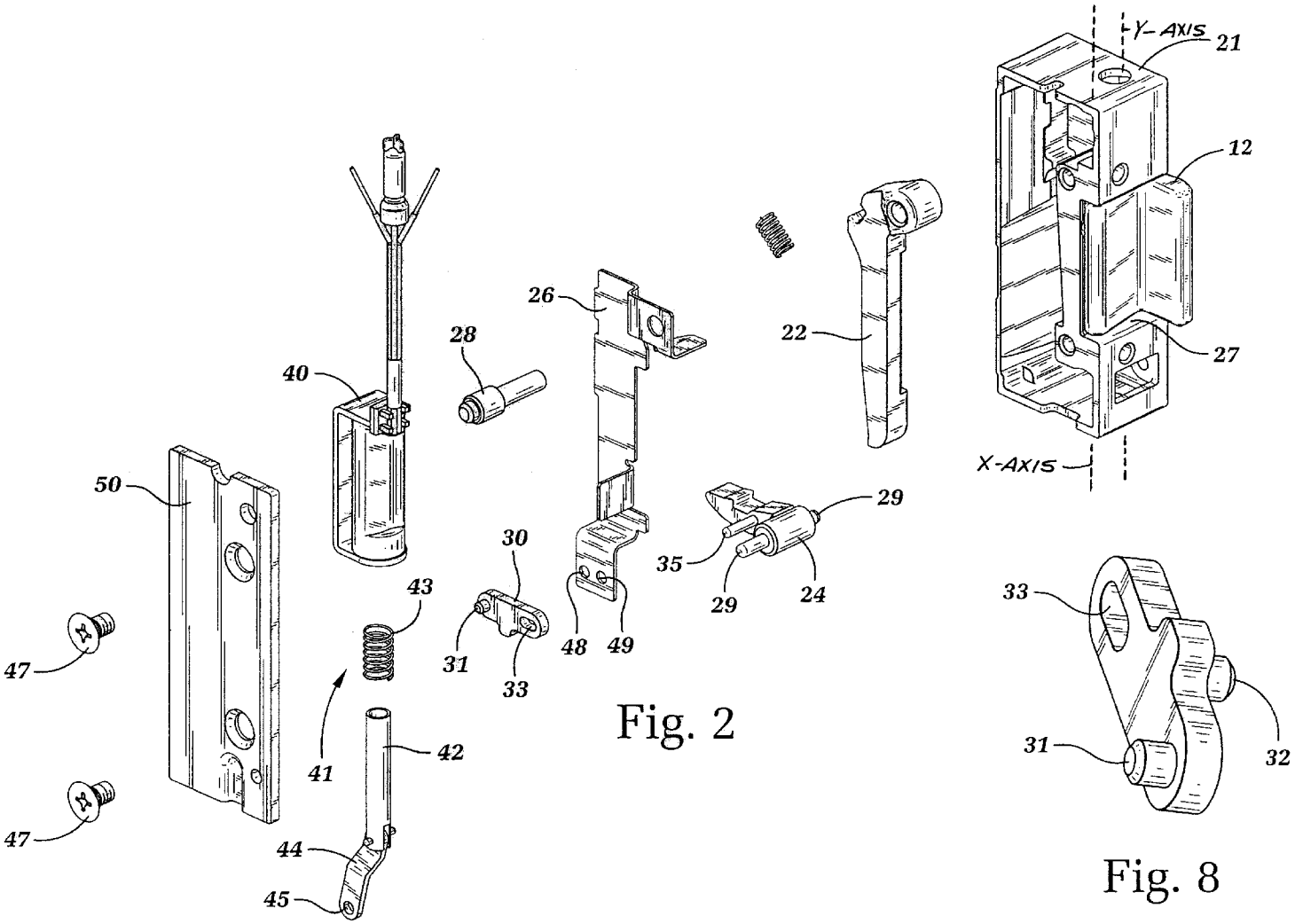
FIG. 2 is an exploded perspective view, of a backbox assembly of the electric strike of FIG. 1.
FIG. 8 is a perspective view of the actuator shown in FIG. 2.

Referring now to FIG. 2, the backbox assembly 20 is shown in an exploded form. The backbox assembly 20 has a strike or backbox frame 21 that constitutes principal support structure of the strike. The backbox frame 21 defines a jam face opening 27 that, after assembly, is oriented within a door frame toward a door and generally coplanar with a jam face of the door frame. The jam face opening 27 forms a locking cavity whereby the bolt of a lock on the door can be captured to lock the door, or swing there through to allow opening of the door.

Locking and Unlocking

Referring again to FIG. 2 the backbox assembly 20 contains three main locking components. These components are a keeper 12, lock arm 22 and lock link 24. These components interact to provide the strike with locking and unlocking capabilities. The locking and unlocking of these three components is controlled by a fail-safe/fail-secure mechanism comprising an actuator 30, and a solenoid assembly shown generally at 41, solenoid attachment 44, solenoid 40 with a plunger 42.

In operation of the components shown in FIG. 2, electrical power is supplied to or cut off from the strike 10 to lock or unlock the keeper 12 depending on the user's preferred mode of operation. This either retains a latch on the door lock in the locking cavity or allows the latch to rotate the keeper and open the door. The user specifies which mode the strike is to be in by setting the mechanism appropriately to take constant supply of power or no power at all to lock or unlock the door.

Figure 3:
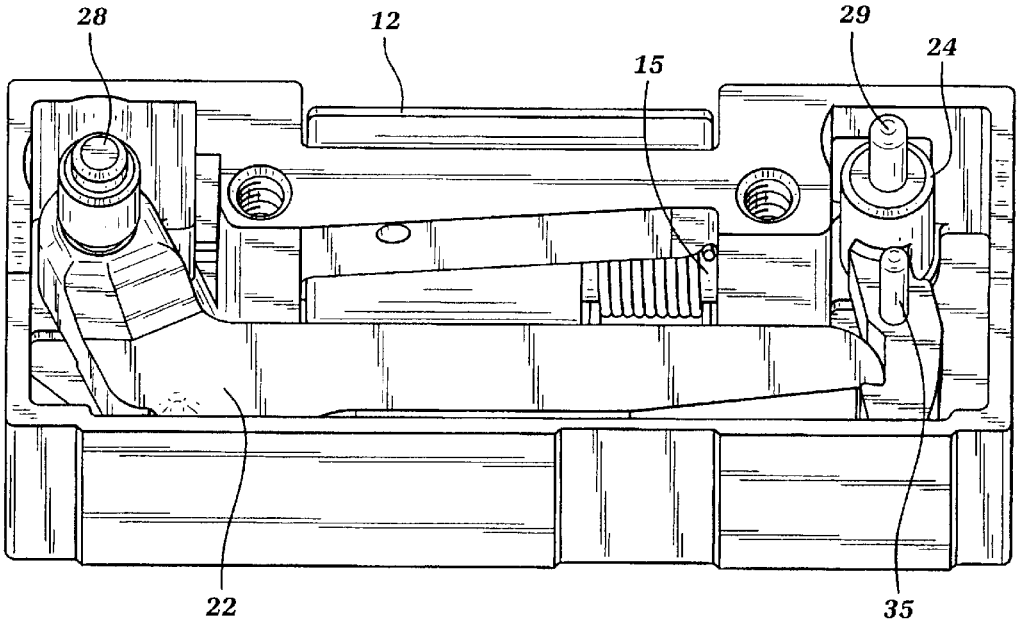
FIG. 3 is a front perspective view, with a backplate, solenoid assembly, and actuator removed, of the backbox assembly of FIG. 1.
Figure 4:
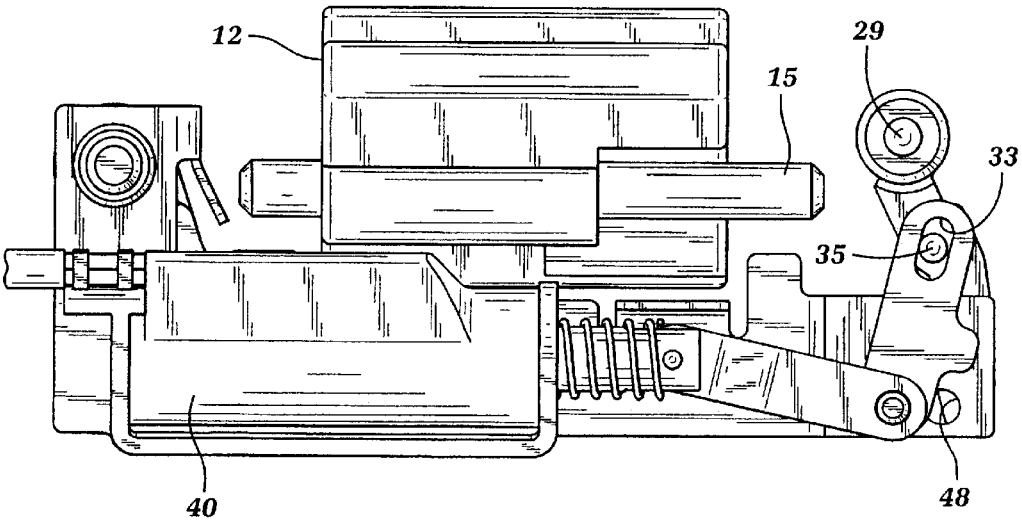
FIG. 4 is a partial front view of certain components inside the backbox assembly of FIG. 1, shown in an unlocked position of the electric strike.
Figure 5:
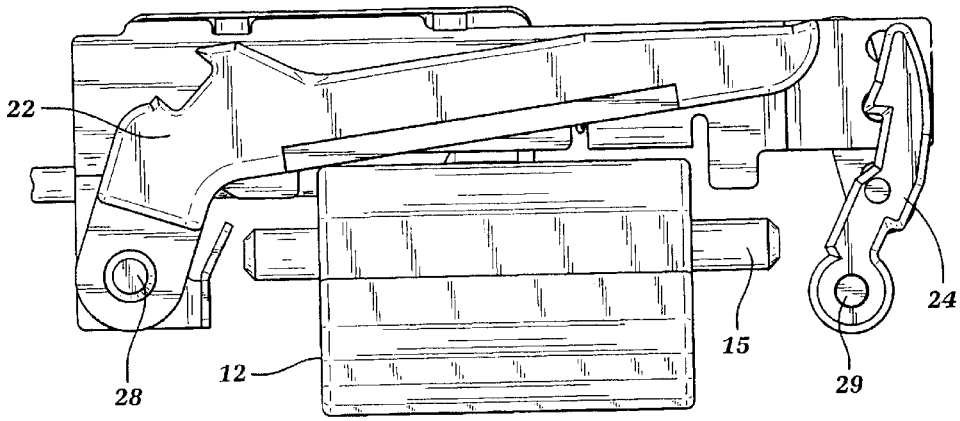
FIG. 5 is a partial back view of certain components of the backbox assembly of FIG. 1, shown in an unlocked position of the electric strike.
Figure 6:
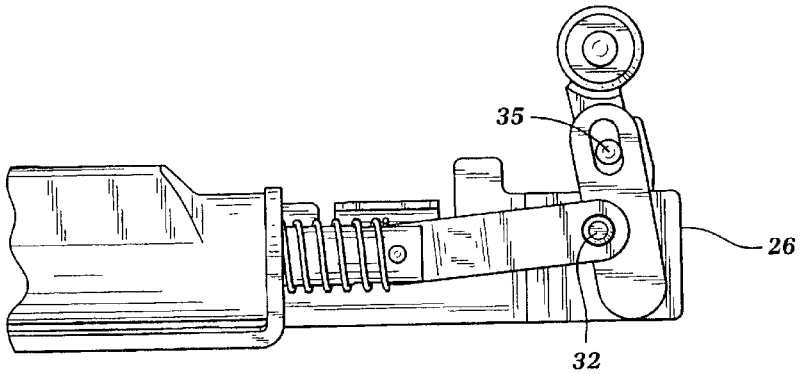
FIG. 6 is a front view of the actuator, solenoid attachment plunger and lock link of FIG. 4 assembled with the electric strike in fail-safe mode.
Figure 7:
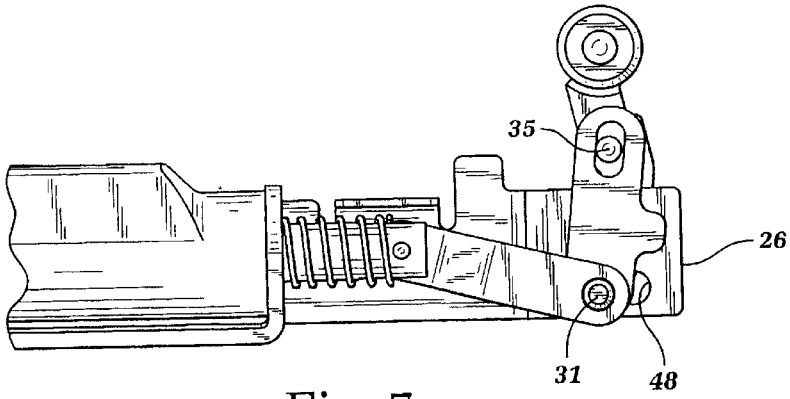
FIG. 7 is a front view of the solenoid assembly, actuator, and lock link of FIG. 6 assembled in a fail-secure mode.

Locking is accomplished by the respective orientation of the three main locking components contained in the backbox assembly 20. Referring to FIGS. 2 and 3 these components are shown and, in FIG. 3, the components are shown in a locked position. The keeper 12 rotates or swivels about a keeper pin 15 oriented along the X axis (as shown in FIG. 2) of the assembly. The keeper pin 15 is not visible in FIG. 2 but is shown in FIGS. 3, 4 and 5. Referring again to FIGS. 2 and 3 the lock arm 22 rotates about the lock pin 28 oriented along the Y axis (as shown in FIG. 2) of the assembly. The lock link 24 pivots about its own pin 29, also oriented to swivel or rotate along the Y axis. The lock arm 22 blocks the keeper's rotation and a lock link 24 blocks the lock arm's rotation when the strike is in its locked position. The unlocked position occurs when the keeper 12 and the lock arm 22 are allowed to rotate about their respective axes.

Referring now to FIGS. 4 and 5, a portion of the backbox assembly 20 is shown in an unlocked position. In FIG. 5, the lock arm 22 is shown rotated away from the keeper 12 which permits the keeper 12 to rotate about its keeper pin 15. This unlocked position is accomplished by rotating the lock link 24 with the fail-safe/fail-secure mechanism thus unblocking the lock arm 22.

Fail-safe and Fail-secure Modes

The fail-safe/fail-secure mechanism controls the locking and unlocking of the lock link 24 and thereby the locking and unlocking of the strike 10. Actuation of the lock link is directly controlled through an actuator 30. The actuator 30 also controls the fail-safe (FS) and fail-secure (FSE) interchangeability of the strike 10. The actuator 30 is shaped as a pivoting arm and has two bosses 31 and 32 (best shown in FIG. 8). The two bosses are provided on opposite sides of the actuator 30. The actuator 30 also has a slot 33 located at one end of the actuator 30 opposite the end upon which boss 31 is located. Referring now to FIGS. 4, 6, 7, and 8 it can be seen how the slot 33 interacts with a lock link actuator pin 35 on the lock link 24. When the actuator 30 is pivoted or rotated, the lock link is pivoted or rotated to block or unblock the lock arm 22 when voltage is supplied to the solenoid 40. When the strike 10 is in the FSE or FS mode, one boss on the actuator pivots about a respective FSE hole 49 or FS hole 48 on the separator plate 26, and the other boss on the actuator 30 interfaces with the solenoid attachment 44. The solenoid plunger 42 is attached to a solenoid attachment 44 providing the necessary physical motion from the solenoid 40. Therefore, when the solenoid plunger 42 is pushed in or out this operates the solenoid attachment 44 which ultimately causes rotation of the lock link 24. Correspondingly rotation of the lock link 24 blocks or unblocks movement of the lock arm 22.

It is been stated previously that an object of this invention is to facilitate simple and easy changeover from fail-secure to fail-safe mode or vice versa. Referring now to FIG. 2 the strike 10 can be changed from fail-secure to fail-safe mode by removing backplate screws 47 from the back plate 50 on the backbox assembly 20. The solenoid 40 along with the plunger 42, plunger spring 43, and solenoid attachment 44 is removed by lifting it along the Y axis. The actuator 30 is then rotated 180°, or turned over, and replaced so that the boss that was in a solenoid attachment hole 45 is now inserted into the fail-safe hole 48 in the separator plate 26. The lock link pin 29 is again located in the actuator slot 33. The solenoid assembly is replaced in the backbox assembly 20, oriented as before except that the solenoid attachment hole 45 is now oriented over the available boss 32 on the newly available side of the actuator 30. This boss 32 was previously located in the fail-secure bole 49 in the separator plate 26. The back plate 50 and screws 47 are then replaced to complete the backbox assembly.

Changing from fail-safe to fail-secure mode is done in the same manner. However, an actuator boss 31 is inserted in the fail-secure hole 49 on the separator plate 20, and the solenoid attachment hole 45 is oriented over the remaining actuator boss 32. The actuator 30 can be configured in different embodiments and still perform the functions described.

This unique design of the actuator 30 and its ability to interact with the solenoid attachment 44, separator plate 26 and lock link 24 ultimately provides a very simple and efficient mechanism that permits easy changeover between fail-secure and fail-safe mode while the strike is in the field. This changeover is done in a manner that is repeatable without destruction of the mechanism. The ability to change from fail-safe to fail-secure modes and vice versa quickly is a main feature of this invention. This change can be made quickly because of the accessibility to the fail-safe fail-secure mechanism. It requires minimal part removal, and the simplicity in which the mechanism can be interchanged involves only one part reorientation. The user can reduce installation time and complexity as a result. This strike 10 allows the user to inventory only one strike that handles fail-safe and fail-secure job requirements instead of two different strikes or mechanisms.

Many existing products in this market require multiple parts to be removed for interchanging between fail-safe and fail-secure modes. Other products have only one mode of operation, and it must be specified when ordering the strike from the factory. The present invention provides a complete package of field-selectability to the end user without the common disadvantages.

Preferred embodiments of the present invention have been illustrated and described. It is to be recognized that modifications will be well within the ability of those skilled in the art. Therefore, the appended claims are intended to cover any and all modifications which fall within the scope of the invention.

What is claimed is:

1. An electrically controlled strike for securing a door to a frame comprising:

a strike frame;

a keeper carried by said strike frame, the keeper movable between a blocking position preventing movement of the door relative to the frame and a non-blocking position allowing movement of the door relative to the frame;

a solenoid carried by said strike frame and movable relative to said strike frame, said solenoid including a plunger and a solenoid attachment pivotably coupled to said plunger; and an actuator moveable between a fail-safe condition, in which said actuator allows movement of said keeper when said solenoid is unpowered, and a fail-secure condition, in which said actuator prevents movement of said keeper when said solenoid is unpowered, said actuator having a first side and a second side, said first side including a first boss and said second side including a second boss, said first boss being engageable with said solenoid attachment in said fail-secure condition, said second boss being engageable with said solenoid attachment in said fail-safe condition.

2. The strike of claim 1 further comprising a separator plate housed in said strike frame, said first boss being engageable with said separator plate in said fail-safe condition, said second boss being engageable with said separator plate in said fail-secure condition.

3. The strike of claim 1 further comprising a lock link that is pivoted by said actuator, said lock link operating in connection with a lock arm to block or unblock movement of said keeper.

4. An electrically controlled strike for securing a door to a frame comprising:

a strike frame;

a keeper carried by said strike frame, the keeper movable between a blocking position preventing movement of the door relative to the frame and a non-blocking position allowing movement of the door relative to the frame;

a solenoid carried by said strike frame and movable relative to said strike frame;

means operatively connected between said solenoid and said keeper, said means repositionable between a fail-safe condition allowing keeper movement when said solenoid is unpowered, and a fail-secure condition preventing keeper movement when said solenoid is unpowered wherein said means includes an actuator, said actuator being moveable between a first actuator position causing said fail-safe condition and a second actuator position causing said fail-secure condition;

wherein said means includes a solenoid attachment connecting said solenoid to said actuator and a lock link that is pivoted by said actuator, said lock link operating in connection with a lock arm to block or unblock movement of said keeper;

wherein said actuator comprises a pivoting arm, said arm having two actuator bosses and a slot.

5. The strike of claim 4 wherein said actuator slot connects with said lock link and alternatively, one or the other of said actuator bosses is connected to said solenoid attachment.

6. The strike of claim 5 wherein said means includes a separator plate having two holes, one of said actuator bosses inserted into one of said holes in said fail-safe mode and the other of said bosses inserted in the other of said holes in said fail-secure mode.

7. The strike of claim 6 wherein said actuator is turned over between said first actuator position and said second actuator position.

8. The strike of claim 7 wherein said actuator includes:

i) said slot positioned at one end of said actuator, said slot interacting with a lock link actuator pin on said lock link;

ii) one of said bosses is positioned on one side of said actuator;

iii) the other of said bosses is positioned on the opposite side of said actuator; and iv) the other of said bosses is positioned at an end of said actuator opposite said one end with said slot.

9. An electrically controlled strike for securing a door to a frame comprising:

a strike frame;

a keeper carried by said strike frame for movement when released, allowing door opening, said keeper adapted to receive and resist door opening force prior to keeper movement;

a solenoid carried by said strike frame to have either of two alternate positions relative to said strike frame;

means operatively connected between said solenoid and said keeper for causing said keeper to assume;

i) a fail-safe condition allowing keeper movement when said solenoid is unpowered;

ii) a fail-secure condition preventing keeper movement when said solenoid is unpowered.

wherein said means includes an actuator, said actuator having a first actuator position causing said fail-safe condition and a second actuator position causing said fail-secure condition said actuator being turned over to change between said first and said second position;

a solenoid attachment connecting said solenoid to said actuator and a lock link that is pivoted by said actuator, said lock link operating in connection with a lock arm to block or unblock movement of said keeper;

said actuator comprises a pivoting arm said arm having two bosses and a slot;

wherein said actuator slot connects with said lock link and alternatively, one or the other of said bosses connects with said solenoid attachment;

wherein said means includes a separator plate having two holes, one of said actuator bosses inserted into one of said holes in said fail-safe mode and the other of said bosses inserted in the other of said holes in said fail-secure mode.

10. An electrically controlled strike for securing a door to a frame comprising:

a strike frame;

a keeper movably supported in said strike frame for movement between a release position, in which the door is openable, and a closed position, in which the door is resisted from opening;

a solenoid carried by said strike frame and moveable between a first position relative to said strike frame and a second position relative to said strike frame;

a separator plate housed in said strike frame; and an actuator moveable between a fail-safe condition, in which said actuator allows movement of said keeper when said solenoid is unpowered, and a fail-secure condition, in which said actuator prevents movement of said keeper when the solenoid is unpowered, said actuator including a first side and a second side, said first side including a first boss and said second side including a second boss, said first boss being engageable with said support plate in said fail-safe condition and said second boss being engageable with said support plate in said fail-secure condition.

11. The electrically controlled strike of claim 10, wherein said actuator has a first end and a second end and an aperture adjacent said first end.

12. The electrically controlled strike of claim 10, further comprising a lock arm pivotably coupled to said strike frame and pivotably movable relative to said strike frame between an engaged position, in which said locking arm matingly engages said keeper, and a non-engaged position, in which said locking arm disengages said keeper.

13. The electrically controlled strike of claim 12, further comprising a spring and wherein said spring biases said lock arm toward said engaged position.

14. The electrically controlled strike of claim 12, wherein said engaged position corresponds to said closed position and said non-engaged position corresponds to said release position.

15. The electrically controlled strike of claim 12, further comprising a lock link pivotably coupled to said strike frame to matingly engage said locking arm.

16. The electrically controlled strike of claim 15, wherein said actuator has a first end, a second end, and an aperture adjacent said first end, and wherein said lock link extends into said aperture, pivotably engaging said locking arm.

17. The electrically controlled strike of claim 10, further comprising a plunger coupled to said solenoid for movement with said solenoid between said first position and said second position.

18. The electrically controlled strike of claim 17, further comprising a spring having a first spring end and a second spring end, said first spring end engaging said solenoid and said second spring end engaging said plunger, said spring biasing said solenoid toward said first position.

19. The electrically controlled strike of claim 17, further comprising a solenoid attachment pivotably coupled to said plunger.

20. An electrically controlled strike for securing a door to a frame comprising:

a strike frame;

a keeper movably supported in said strike frame for movement between a release position, in which the door is openable, and a closed position, in which the door is resisted from opening;

a solenoid carried by said strike frame and moveable between a first position relative to said strike frame and a second position relative to said strike frame;

an actuator moveable between a fail-safe condition, in which said actuator allows movement of said keeper when said solenoid is unpowered, and a fail-secure condition, in which said actuator prevents movement of said keeper when the solenoid is unpowered; and a separator plate having a first hole and a second hole and extending through said strike frame.

21. The electrically controlled strike of claim 20, wherein said actuator has a first side and a second side, said first side including a first boss and said second side including a second boss, and wherein said first boss matingly engages said first hole in said fail-safe condition and said second boss matingly engages said second hole in said fail-secure condition.

22. The electrically controlled strike of claim 21, further comprising:

a plunger coupled to said solenoid for movement with said solenoid between said first position and said second position; and a solenoid attachment pivotably coupled to said plunger, said second boss matingly engaging said solenoid attachment in said fail-safe condition and said first boss matingly engaging said solenoid attachment in said fail-secure condition.

* * * * *